US008678909B1

(12) United States Patent
Finn

(10) Patent No.: US 8,678,909 B1
(45) **Date of Patent: *Mar. 25, 2014**

(54) SLOT MACHINE GAME WITH SYMBOL PERSONALIZATION

(76) Inventor: Brian Finn, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/594,822

(22) Filed: Aug. 26, 2012

Related U.S. Application Data

(63) Continuation of application No. 12/610,870, filed on Nov. 2, 2009, now Pat. No. 8,251,797.

(51) Int. Cl.
*A63F 9/24* (2006.01)

(52) U.S. Cl.
USPC ..... 463/20; 463/21

(58) Field of Classification Search
USPC ..... 463/20, 21
See application file for complete search history.

(56) References Cited

U.S. PATENT DOCUMENTS

| | | | | |
|---|---|---|---|---|
| 2009/0117959 | A1* | 5/2009 | Nicely | 463/13 |
| 2010/0056254 | A1* | 3/2010 | Jackson | 463/20 |
| 2010/0120484 | A1* | 5/2010 | Caputo et al. | 463/13 |
| 2010/0124979 | A1* | 5/2010 | Acres | 463/20 |
| 2010/0261518 | A1* | 10/2010 | Randall | 463/20 |
| 2011/0053680 | A1* | 3/2011 | Acres | 463/25 |
| 2012/0077581 | A1* | 3/2012 | Pawloski et al. | 463/30 |

* cited by examiner

*Primary Examiner* — Pierre E Elisca
(74) *Attorney, Agent, or Firm* — Muskin & Farmer LLC

(57) ABSTRACT

A slot machine game that customizes winning combinations based on the player's year of birth. In this way, the player's gaming experience can be tailored to themes such as the Chinese Zodiac. The player's year of birth can be inputted directly into the machine or the machine can automatically query the casino database if the player uses his or her player's card to find out the year of birth.

12 Claims, 4 Drawing Sheets

SLOT MACHINE GAME WITH SYMBOL PERSONALIZATION

CROSS REFERENCE TO RELATED APPLICATIONS

This application is a continuation application of U.S. application Ser. No. 12/610,870, which is incorporated by reference herein in its entirety.

BACKGROUND OF THE INVENTION

1. Field of the Invention

The present general inventive concept is directed to a method, apparatus, and computer readable storage medium for a personalized slot machine paytable.

2. Description of the Related Art

Casinos are constantly installing new varieties of slot machines in order to attract and retain players. Some players are superstitious and feel that personal characteristics about them may invoke a lucky result.

Therefore, what is needed is a slot machine game that can be personalized to a player in order that the player feels that they may have a connection to the slot machine game.

SUMMARY OF THE INVENTION

It is an aspect of the present invention to provide more innovative slot machine games.

The above aspects can be obtained by a gaming machine that includes (a) executing a following instructions on a processor on a digital computer: (b) determining a birthyear for the player; (c) determining a particular paytable based on the birthyear; (d) displaying the particular paytable; (e) receiving a wager from a player; (f) spinning reels and stopping the reels to a random final combination; and (g) determining if the final combination is a winning combination on the paytable and paying any earned award to the player based on the final combination.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
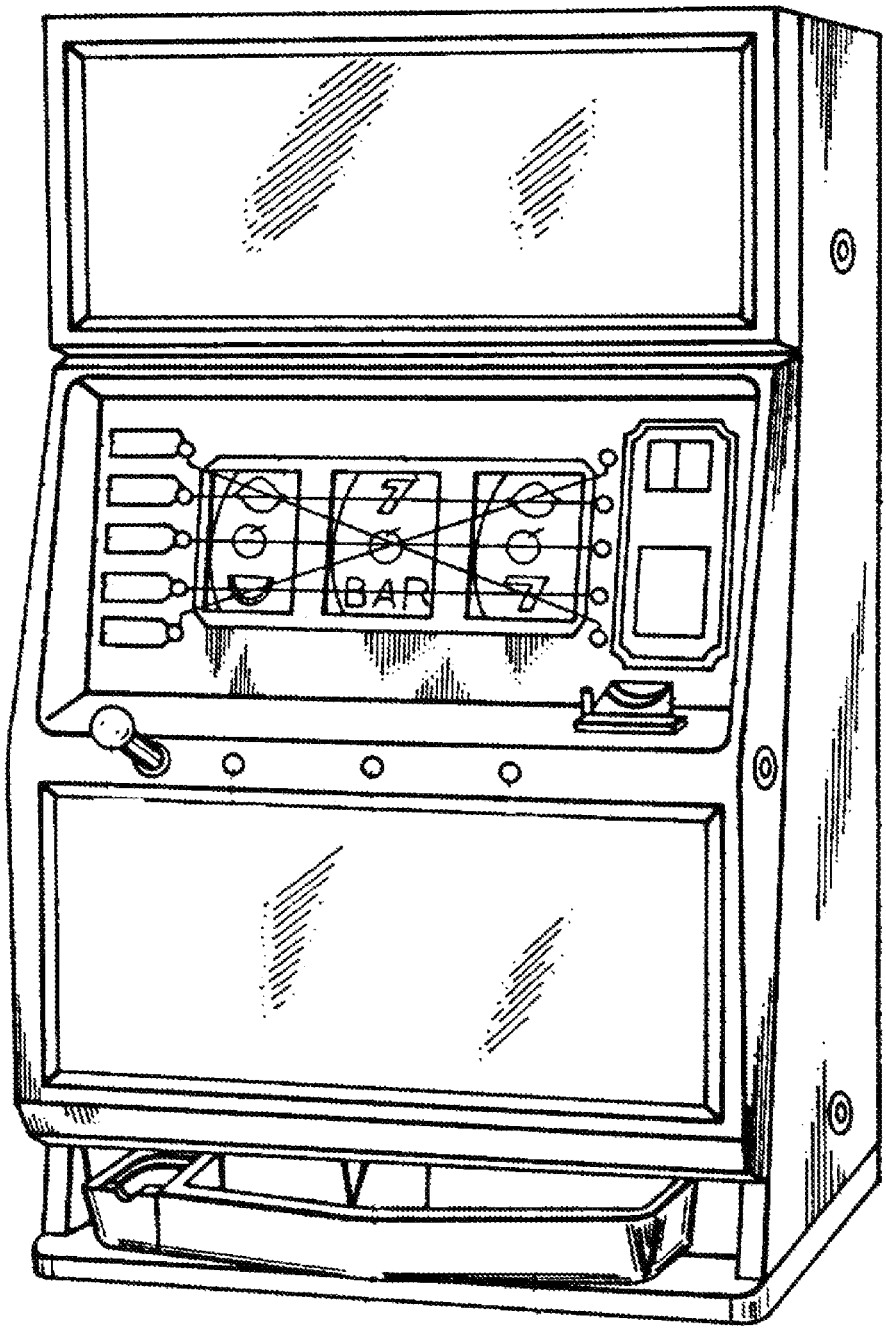
FIG. 1 is drawing illustrating one type of slot machine that can be used to implement the present inventive concept, according to an embodiment.

Reference will now be made in detail to the presently preferred embodiments of the invention, examples of which are illustrated in the accompanying drawings, wherein like reference numerals refer to like elements throughout.

The present general inventive concept is directed to a slot machine game, (such as the kind described in U.S. Pat. No. 7,553,231 which is incorporated by reference herein in its entirety), that can have a payout structure that is customized based on personalized player information, such as the year the player was born.

Slot machines typically have paytables that are compared to a final symbol combination after the player purchases a spin. A player would typically pay for a spin (by using coins, cash, or credits), spin the reels, and watch the result. The resulting symbols can be grouped into predetermined paylines, and symbols that fall along particular paylines are compared to the paytable to see if there are any winning combinations.

Some players feel that their year of birth is lucky, and thus they may wish to play a slot machine that can incorporate their birth year into the overall slot machine play. This can be done in numerous ways. For example, the player can input their birth year into a machine (or the machine can ascertain the birth year automatically by using the player's inserted comp card and the casino database), and this information can be used to customize the player's gaming experience.

FIG. 1 is drawing illustrating one type of slot machine that can be used to implement the present inventive concept, according to an embodiment.

While a mechanical slot machine is illustrated in FIG. 1, a video slot machine can also be used as well.

Figure 2:
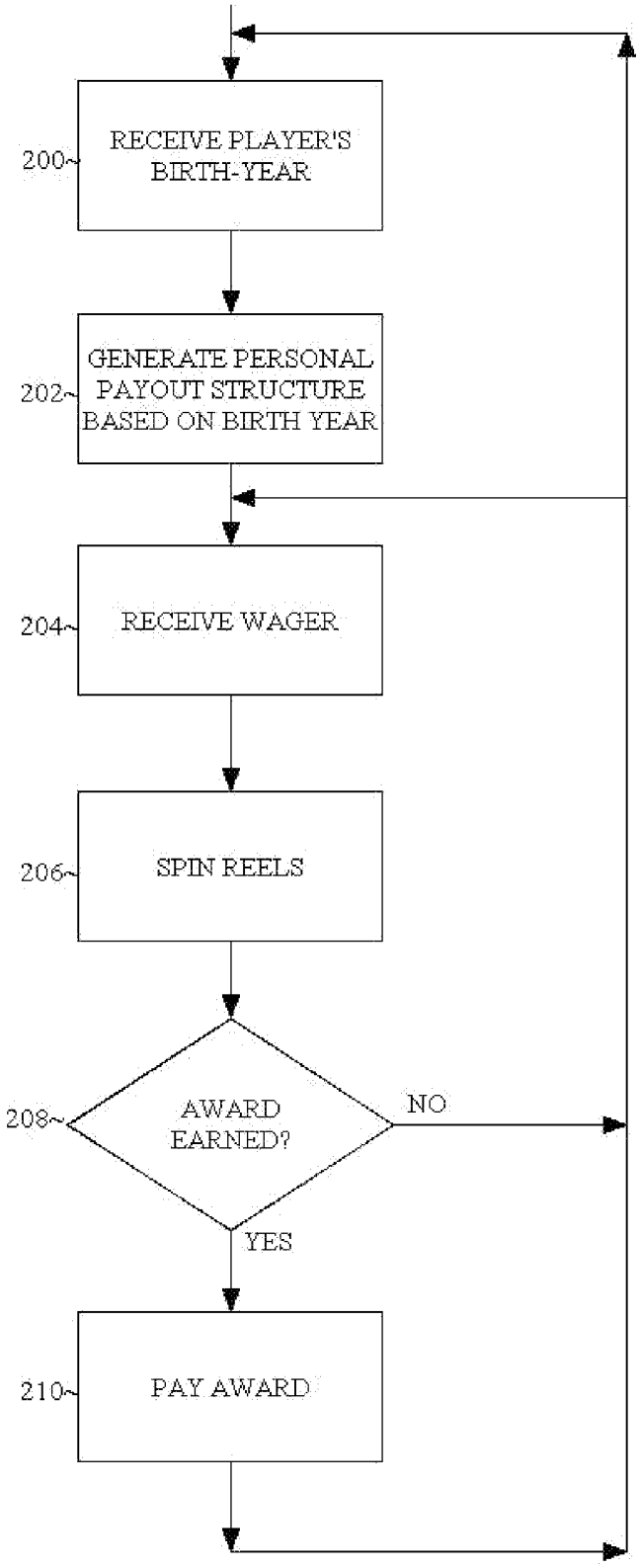
FIG. 2 is a flowchart illustrating an exemplary method to implement a slot machine game, according to an embodiment.

FIG. 2 is a flowchart illustrating an exemplary method to implement a slot machine game, according to an embodiment.

The method can begin with operation 200, which receives the player's birth-year. This can be done in numerous ways. For example, the player can enter in their respective birth-year on a keypad or using a touch screen. Alternatively, they can enter a category associated with their birth-year, for example their particular sign of the Chinese-zodiac. Alternatively, the system may be able to automatically identify the player's birth-year if the player has inserted their player's card (also known as loyalty card, comp card, etc.) into a card reader associated with the slot machine they are playing. The slot machine can use an identifier on the player's card to query a casino database to determine the player's birth-year (or other personal information).

In another embodiment, instead of the birth-year, other aspects about the player can be received and used, such as the player's birthday. This information can be used to associate the player with the player's astrological sign which is based on the player's birthday but not year of birth. All of the embodiments described herein that apply to birth-year and the Chinese Zodiac can also be applied to the player's birthday and their astrological sign as well (e.g., Scorpio, Leo, etc.)

In a further embodiment, instead of using the player's actual birth-year (or birthday), the player can pick a birth-year or birthday of their preference (even if it is not their actual birth-year or birthday). For example, if a player feels that rabbits are lucky they can select rabbit for their birth-year symbol even though they were born in the year of the ox.

From operation 200, the method proceeds to operation 202, which generates a personal payout structure based on the player's birth-year (or in another embodiment, based on the astrological sign which is based on their birthday).

For example, a table such as Table I can be used to put the player's birth-year into a category.

TABLE 1

| birth-year | category |
|---|---|
| 1973 | ox |
| 1985 | ox |
| 1997 | ox |
| 1974 | tiger |
| 1986 | tiger |
| 1998 | tiger |
| 1975 | rabbit |
| 1987 | rabbit |
| 1999 | rabbit |
| 1976 | dragon |
| 1988 | dragon |
| 2000 | dragon |
| 1965 | snake |
| 1977 | snake |
| 1989 | snake |
| 1966 | horse |
| 1978 | horse |
| 1990 | horse |
| 1967 | sheep |
| 1979 | sheep |
| 1991 | sheep |
| 1968 | monkey |
| 1980 | monkey |
| 1992 | monkey |
| 1969 | rooster |
| 1981 | rooster |
| 1993 | rooster |
| 1970 | dog |
| 1982 | dog |
| 1994 | dog |
| 1971 | pig |
| 1983 | pig |
| 1995 | pig |
| 1972 | rat |
| 1984 | rat |
| 1996 | rat |

Of course, instead of a table such as that in Table I, a formulaic approach can be used to determine the category as well. Once the category is determined, a paytable associated with that category can be determined/retrieved. Table II illustrates different paytables for some of the categories in Table I. The payouts illustrated in Table II are for a three reel game, although any number of reels can be used with the inventive concepts described herein.

TABLE II

| Category | Combination | payout |
|---|---|---|
| Rat | rat/rat/rat | $1,000 |
| | 7/7/7 | $100 |
| | star/star/star | $10 |
| | any two stars | $2 |
| | any one star | $1 |
| Ox | ox/ox/ox | $1,000 |
| | 7/7/7 | $100 |
| | star/star/star | $10 |
| | any two stars | $2 |
| | any one star | $1 |
| . | | |
| . | | |
| . | | |

An entry should exist in Table II for each category. Typically, different categories should not have a different house advantage so that the players will not be rewarded or penalized because of their particular characteristics. In an alternative embodiment, different characteristics (e.g., birth-year) may have an effect on the house advantage of the respective paytable for that category. Additionally, other paytables or payouts can be used such that getting three (or another number) of identical symbols that don't correspond to the selected category (e.g., animal year or zodiac symbol) can generate a payout of 0 or a lesser amount (e.g., 1-10 or other numbers) than getting the same number of identical symbols of the category.

Thus, for example, according to the paytables in Table II, if the category is "rat" and the player gets three rats, then the player wins $1,000. But if the player were to get three oxen while the player's category is rat, the player would win nothing.

The reels for the game should typically not change based on the player's category. Table III below illustrates one sample reel mapping which can be used for all three reels in a three reel game. The reel in table III has only 16 stops, although reels commonly have 64 reel stops.

TABLE III

| reel stop # | symbol |
|---|---|
| 1 | blank |
| 2 | star |
| 3 | rat |
| 4 | ox |
| 5 | tiger |
| 6 | rabbit |
| 7 | dragon |
| 8 | snake |
| 9 | horse |
| 10 | sheep |
| 11 | monkey |
| 12 | rooster |
| 13 | dog |
| 14 | pig |
| 15 | star |
| 16 | star |

From operation 202, the method can proceed to operation 204 which receives the player's wager. This can be done as known in the art, such as the player presenting cash or a voucher to credit the machine, and then pressing a 'spin' button to wager particular credits.

From operation 204, the method proceeds to operation 206, which spins the reels on the slot machine. In a mechanical machine, this is typically done by activating a stepper motor to stop at particular randomly determined symbols. In a video machine, this is done by using computer generated animation to animate spinning reels until they stop at random positions.

From operation 206, the method proceeds to operation 208, which determines whether the final combination displayed in operation 206 is a combination on the customized paytable determined in operation 202. If the final combination is not a winning combination, that is, no active payline on the final combination contains a combination in the customized paytable, then the method can return to operation 204 wherein the player can place another wager, or the method can return to operation 200, when a new player plays and a new birth-year is entered.

If the determination in operation 208 determines that there is an award earned, then the method proceeds to operation 210, which pays a respective award for the combination earned. Then the method can return to either operation 204, wherein the player can place another wager, or the method can return to operation 200, when a new player plays and a new birth-year is entered, or the same player continues to play but changes the category.

Figure 3B:
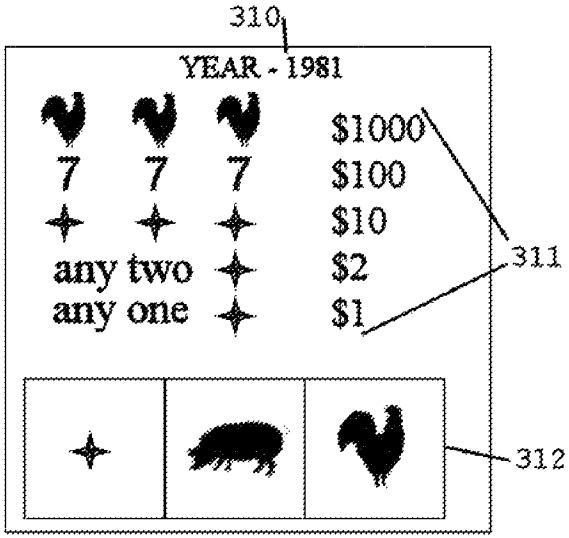
FIG. 3B is a drawing illustrating a second configuration of the slot machine, according to an embodiment.
Figure 3A:
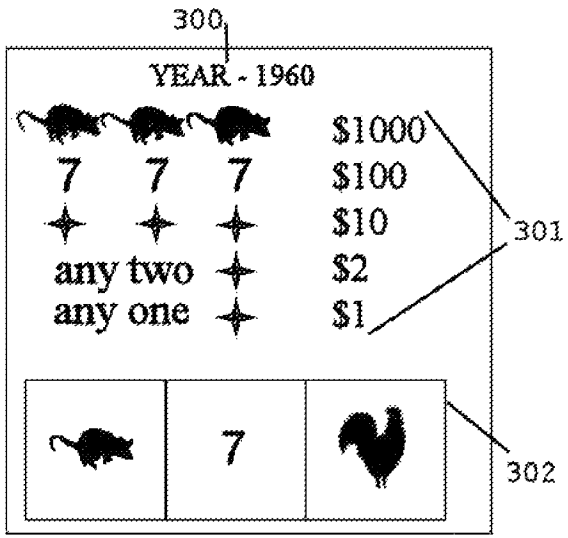
FIG. 3A is a drawing illustrating a first configuration of a slot machine, according to an embodiment.

FIG. 3A is a drawing illustrating a first configuration of a slot machine, according to an embodiment.

A birth-year output 300 displays that the year of birth for the player is 1960, which puts the player in the category of the "rat" according to Table I. A particular paytable 301 for the rat category is displayed (which can be retrieved from a table such as Table II), which can be displayed using LCD (or other) technology. The reels 302 of the slot machine are also displayed. The reels 302 can be video or mechanical.

FIG. 3B is a drawing illustrating a second configuration of the slot machine, according to an embodiment.

A birth-year output 310 shows that the year of birth for this player is 1981, which puts the player in the category of the "hen" according to Table I. A particular paytable 311 for the hen category is displayed (which can be retrieved from a table such as Table II), which can be displayed using LCD (or other) technology. The reels 312 of the slot machine are also displayed, which can be video or mechanical reels.

Figure 4:
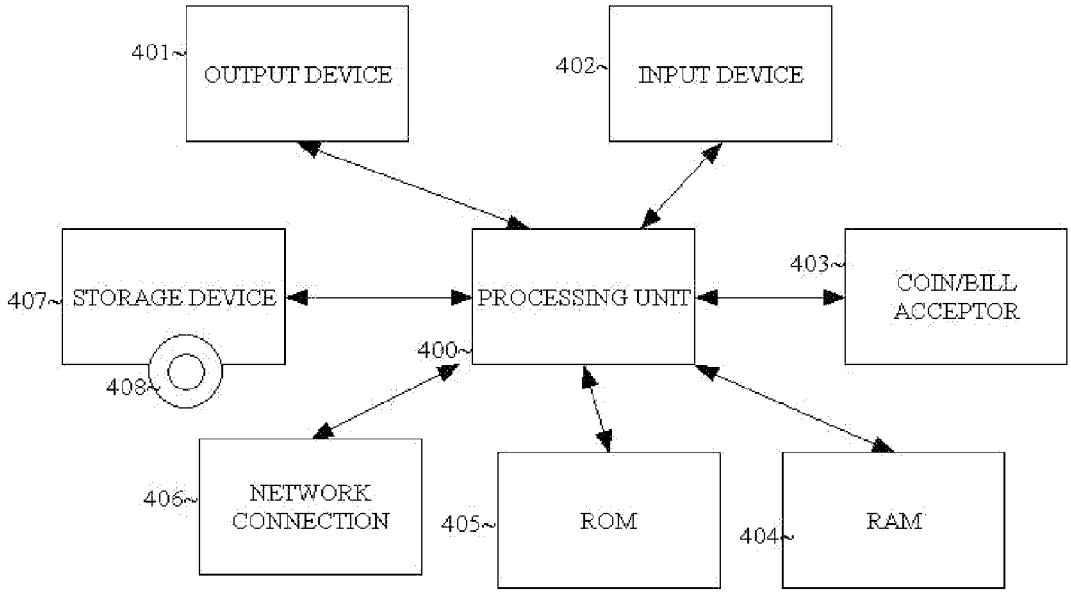
FIG. 4 is a block diagram illustrating hardware that can be used to implement the present inventive concepts, according to an embodiment.

FIG. 4 is a block diagram illustrating hardware that can be used to implement the present inventive concepts, according to an embodiment.

A processing unit 400 can be a microprocessor and associated structure (e.g., cache, bus, etc). The processing unit 400 can be connected to an output device 401 (which can be a touch-screen, LCD, speaker, etc.), and an input device 402 (which can be a touch-screen, mouse, keyboard, etc.) The processing unit 400 can also be connected to a coin/bill acceptor 403 which can receive coins and/or bills from a player, as well as vouchers (e.g., TITO) to credit the machine with credits. The processing unit 400 can also be connected to a ROM 405 and RAM 404. The processing unit 400 can also be connected to a network connection 406, which can connect the unit to a computer communications network such as the Internet, WIFI, WAN, LAN, etc. The processing unit 400 can also be connected to a storage device (e.g., CD-ROM, DVD-ROM, hard drive, floppy drive, etc.) which can also read a physical storage medium 408 (e.g., CD, DVD, etc.)

It is also noted that any and/or all of the above embodiments, configurations, variations of the present invention described above can mixed and matched and used in any combination with one another. This also includes any prior document incorporated by reference, and any feature described herein can also be applied to any such documents.

Moreover, any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

The invention claimed is:

1. An apparatus, comprising:
an electronic computer;
a non-transitory computer readable storage medium, storing a program to perform:
determining a birthyear for the player;
determining a particular paytable based on the birthyear;
displaying the particular paytable;
receiving a wager from a player;
spinning reels and stopping the reels to a random final combination; and
determining if the final combination is a winning combination on the particular paytable and paying any earned award to the player based on the final combination and the particular paytable.

2. The apparatus as recited in claim 1, wherein the determining the particular paytable retrieves a particular paytable based on the birthyear.

3. The apparatus as recited in claim 1, wherein the particular paytable is based on a category that is based on the birthyear.

4. The apparatus as recited in claim 3, wherein the particular paytable incorporates symbols associated with the category as a winning combination.

5. A non-transitory computer readable storage medium, storing a program to perform a method comprising:
determining a birthday for the player;
determining a particular paytable based on the birthday;
displaying the particular paytable;
receiving a wager from a player;
spinning reels and stopping the reels to a random final combination; and
determining if the final combination is a winning combination on the particular paytable and paying any earned award to the player based on the final combination and the particular paytable.

6. The computer readable storage medium as recited in claim 5, wherein the determining the particular paytable retrieves a particular paytable based on the birthday.

7. The computer readable storage medium as recited in claim 5, wherein the particular paytable is based on a category that is based on the birthday.

8. The computer readable storage medium as recited in claim 7, wherein the particular paytable incorporates symbols associated with the category as a winning combination.

9. An apparatus to play a slot machine game, the apparatus comprising:
an input device;
an output device;
a processing unit connected to the input device and the output device, the processing unit configured to:
determine a birthday for the player;
determine a particular paytable based on the birthday;
display the particular paytable;
receive a wager from a player;
spin reels and stopping the reels to a random final combination; and
determine if the final combination is a winning combination on the particular paytable and paying any earned award to the player based on the final combination and the particular paytable.

10. The apparatus as recited in claim 9, wherein the processing unit is further configured such that the determine the particular paytable retrieves a particular paytable based on the birthday.

11. The apparatus as recited in claim 9, wherein the processing unit is further configured such that the particular paytable is based on a category that is based on the birthday.

12. The apparatus as recited in claim 11, wherein the processing unit is further configured such that the particular paytable incorporates symbols associated with the category as a winning combination.

* * * * *